United States Patent [19]

Bottamiller et al.

[11] 4,355,585

[45] Oct. 26, 1982

[54] SHELF BUILDERS

[76] Inventors: Wilbert O. Bottamiller, c/o George Spector, 3615 Woolworth Bldg., 233 Broadway; George Spector, 3615 Woolworth Bldg., 233 Broadway, both of New York, N.Y. 10007

[21] Appl. No.: 935,015

[22] Filed: Aug. 18, 1978

[51] Int. Cl.[3] ..... A47B 3/06

[52] U.S. Cl. ..... 108/153; 108/91; 108/107; 403/282

[58] Field of Search ..... 108/111, 91, 107, 153; 24/263 C; 52/DIG. 6, 361, 362, 363, 36, 302; 312/257 A, 265; 403/10, 279, 282, 276, 278; 182/228

[56] References Cited

U.S. PATENT DOCUMENTS

| | | | |
|---|---|---|---|
| 845,156 | 2/1907 | Winchester | 403/282 |
| 1,251,719 | 1/1918 | Wege | 312/265 X |
| 1,900,148 | 3/1933 | Wood | 211/189 X |
| 2,101,378 | 12/1937 | Wiskoff | 52/DIG. 6 |
| 2,153,481 | 4/1939 | Ponselle | 248/345.1 |
| 2,334,912 | 11/1943 | Eide | 108/153 |
| 3,193,051 | 7/1965 | Dosker | 182/228 X |
| 3,316,862 | 5/1967 | Dismuke | 108/91 |
| 3,341,932 | 9/1967 | Haller | 403/282 X |
| 3,368,856 | 2/1968 | Tisdall et al. | 108/91 |
| 3,606,414 | 9/1971 | Haley | 52/363 X |
| 3,612,289 | 10/1971 | Zink | 108/111 |
| 3,712,015 | 1/1973 | Nelson | 52/36 X |
| 3,717,396 | 2/1973 | Dupree | 108/111 |
| 3,779,177 | 12/1973 | Gigante | 312/257 A |
| 3,861,327 | 1/1975 | Silson | 108/111 X |
| 4,265,502 | 5/1981 | Blodee et al. | 52/36 X |

FOREIGN PATENT DOCUMENTS

| | | | |
|---|---|---|---|
| 221618 | 11/1961 | Austria | 24/263 C |
| 1310284 | 10/1962 | France | 52/302 |
| 611111 | 10/1960 | Italy | 52/302 |
| 23036 | of 1898 | United Kingdom | 108/107 |

*Primary Examiner*—James T. McCall

[57] ABSTRACT

A shelf building structure adapted for fast and easy shelf assembly, comprising a vertical stand for supporting one end of a horizontal shelf board. The stand has an opening into which the horizontal board is fitted. Variations of the stand utilize nails or screws for firmly locking the shelf board to the support. In other variations the stand includes intersliding members having opposing nail points for pinning the shelfboard between said members.

2 Claims, 12 Drawing Figures

SHELF BUILDERS

This invention relates generally to shelving construction. The principal objective is to provide a set of shelf builders which enables the erection of a supported shelf in a quick and easy manner. The shelf builders are designed to serve a temporary or long time purpose when the need arises for an instant shelf, because the supports are easily assembled and disassembled.

Another objective is to provide a shelf builder which eliminates the necessity of any tools for assembling and requires no technical skill from the person using shelf builders.

The shelf builders are disclosed herein a variety of designs for wood and molded plastic applications. The designs made of wood are notched or slotted so that the shelf fits snug when attached to the support. The shelf can be secured rigidly to the shelf builder with nails or screws in the wood models shown in drawings. The plastic models are designed to lock in the shelf upon closure of the unit. All models are designed so they can be stacked one level above the other, for the purpose of fulfilling a variety of shelving problems encountered in the home and office as well.

Shelf Builders can be used in bedroom closets for shoe racks, and shoe boxes. Above, as a second level for purses, hats etc., in places of business, in homes or apartments, because they are removable when you leave. They can be used in the kitchen and bath for second level storage from can goods to toilet articles or in the hall closet for additional levels of storage not to mention the work shop or hobby areas for paint and gardening tools.

Figures 1, 2, 3, 4, 5, 6, 7, 7A, 8, 9, 10, 11:
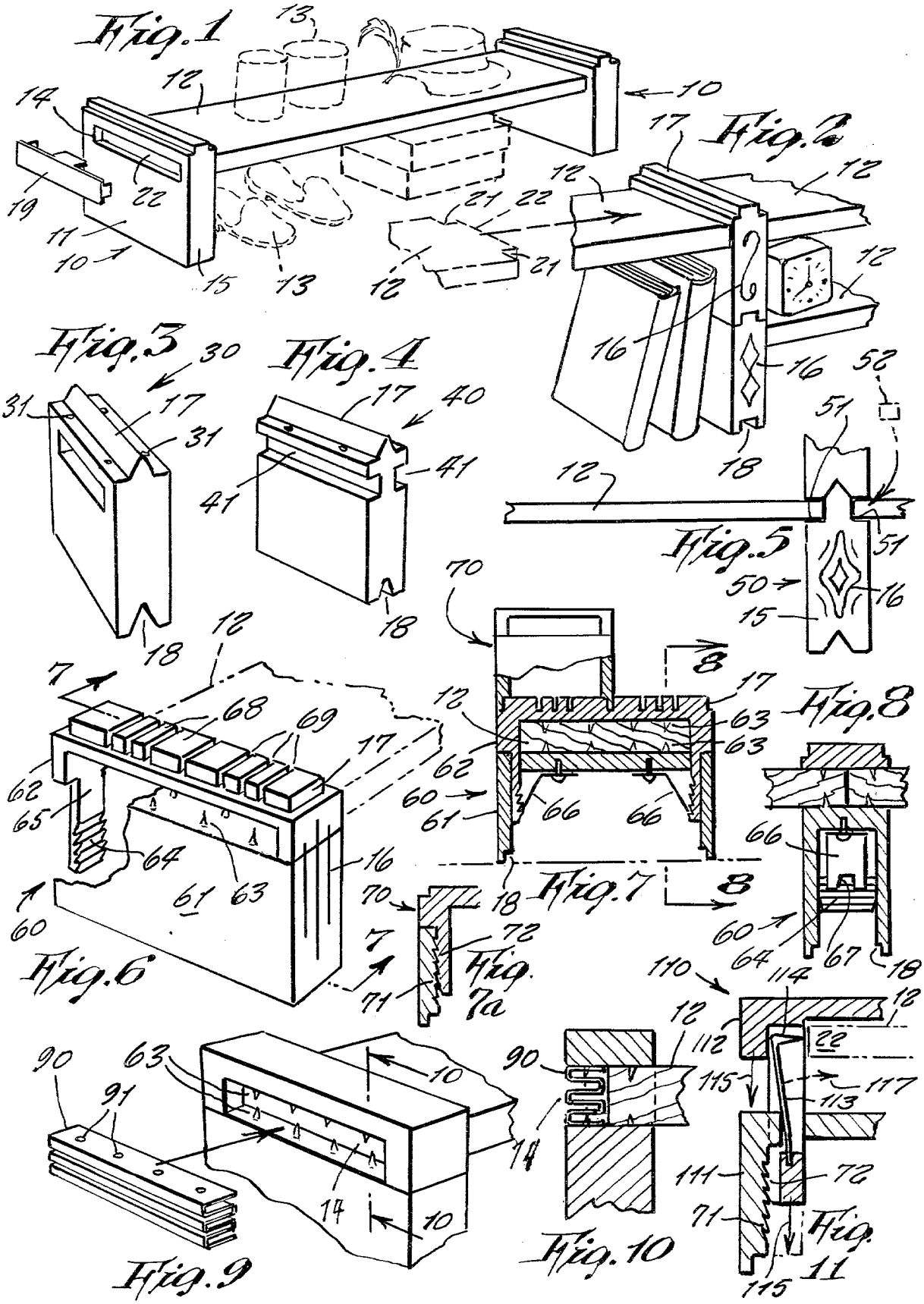
FIG. 1 is a perspective view showing one design of the invention.
FIG. 2 shows it in use for shelves one above another.
FIGS. 3 and 4 show other designs of the invention.
FIG. 5 shows still another design thereof in use.
FIG. 6 shows another design of the invention molded of plastic parts.
FIG. 7 is a cross sectional view thereof.

FIG. 7*a* is a modified design of FIG. 7 in which the plastic parts snap together without the use of any extra metal parts.

FIG. 8 is a cross sectional view through line 8—8.

FIG. 9 shows another design in which an accordian squeezable insert clip gives a grill effect and allows using thicker or thinner shelf boards.

FIG. 10 is a cross sectional view through line 10—10.

FIG. 11 shows another design in which nails pierce the shelf edge automatically during assembly thereby avoiding marking or scratching the top and bottom shelf surfaces.

Referring to the drawing in greater detail, and to FIG. 1, at this time, the reference numeral 10 represents a shelf builder according to the present invention. The vertical board 11 holds up one end of a horizontal shelf 12 upon which and below, various items 13 can be stored. A slotted opening 14, through the upper portions of the board serves to receive the board end or the abutted ends of two shelf boards as shown in the FIG. 2. The front edge 15 of the board 11 is decorated with a design 16 as shown in FIG. 2. The upper edge of the board includes a tongue 17 and a lower edge thereof, has a groove 18. When the shelf builders 10 are placed upon each other, they interfit as shown in FIG. 2. When the shelf builder 10 supports only one shelf end, as shown in FIG. 1, the shelf extends only half way into the outer inner side of opening 14, thus allowing insertion of a clip 19 into the side of the opening 14. The clip 19 snaps in opening 14 with a flush fit providing a neat appearance.

FIG. 2 shows a shelf end with notches 21 reducing the width of shelf end 22, in order to fit into an opening not visible.

FIG. 3 shows another design of shelf builder in which the tongue 17 and groove 18 are V-shaped and holes 31 are provided for receiving nails or screws to secure the shelf after fitting into the opening 14.

FIG. 4 shows another style of FIG. 3 except that instead of the opening 14, a side groove 41 is provided to receive an end of a shelf board.

FIG. 5 shows a shelf builder which is the same as FIG. 4 except that, instead of a groove 41, it employs a shoulder 51 on which a shelf board rests and can be nailed or screwed. A square shaped plug 52 serves to fill a space over a shoulder, if no shelf rests thereupon.

FIGS. 6, 7 and 8 show another design of shelf builder which is made of an interfitting base 61 and top bracket 62, both of which are preferably made of molded hard plastic. A shelf board 12, is placed upon the base 61, and the bracket 62, is slipped down over the shelf board to lock and secure the board between the two surfaces. The Pin-like projections 63 upward from the base and downward from the bracket penetrates into the lower and upper sides of the shelf board to firmly grasp it.

A row of ratchet teeth 64 on each leg 65 of the bracket are engaged by an edge of a leaf spring 66 of FIG. 7, that is secured to the underside of the hollowed out base, to prevent the bracket 62, from accidently being released from the base. However, when wishing to disassemble the above, a screw driver can be inserted into a notch 67 of the spring clip to push the clips edge away from engagement with the ratchet teeth 64 of FIG. 8.

In FIG. 6, the top of the bracket that forms a tongue 17 for engaging a groove 18 at a lower end of a base, is divided into a series of pads 68 by means of cross grooves 69 so that narrower shelf builders 70 may be fitted thereupon as shown in FIG. 7.

FIG. 7*a* is a modified design of FIG. 6. The ratchet teeth 71 of the base engage ratchet teeth 72 of the bracket, when they are slipped together, thus eliminating the need of the above described teeth 64, FIG. 6 and leaf springs 66, FIG. 7.

In FIGS. 9 and 10 an opening 14 of a shelf builder is closable on its unused outer side by an accordian squeezable insert clip 90, instead by above described insert clip 19 of FIG. 1. The clip 90 has openings 91 for engaging projections 63 that lock the clip in from falling out. The clip 90 gives a flush grill effect in appearance.

FIG. 11 is another design of shelf builder that includes a base 111 and a top bracket 112. The base 111 has ratchet teeth 71, which engage the clip 72 of the top bracket. The top bracket also has a flexible pin 113 with a bent angle pointed tip 114 for automatically piercing into the end 22 of the shelf board, when the bracket is pushed down, as shown by the arrow 115.

When the normally inclined pin 113, as shown in FIG. 11 is forced into the side of the shelf 22 by the pressure exerted from the protruding corner of the base 111, the shelf 22 is pinned and locked in position. This is achieved when the downward pressure on bracket 112, the top piece is forced into its lowest position as shown by the arrow 115 of FIG. 11.

In this design the shelf board is lowered together with the bracket downward upon the base.

Different designs of the invention are thus presented.

What is claimed is:

1. A shelf builder comprising in combination a vertical wall and a horizontal shelf, said wall including an upper member and a lower member for retaining said shelf therebetween said members being relatively adjustable including interfitting ratchet teeth on both said members for retaining said members in adjustable positions wherein an end of said shelf extends part way inside an opening inside said wall wherein a flexible inclined pin is mounted at its lower end on a ratchet clip and at its upper end in a recess in said upper member adjacent said shelf said pin includes a pointed tip for piercing transversely an end of said shelf, said inclined pin being urged by an abutting portion of said upper member to move transversely when said members are adjusted together so that said tip pierces said shelf end.

2. The combination of claim 1, wherein said upper member includes a clip which extends through said lower member, said pin being mounted in said clip and extending upwardly through lower member into said recess, said clip having ratchet interfitting with the lower member ratchet teeth.

* * * * *